US006701973B2

(12) United States Patent
Ikemoto et al.

(10) Patent No.: US 6,701,973 B2
(45) Date of Patent: Mar. 9, 2004

(54) SOLID MATTER LOADING METHOD AND A SOLID MATTER LOADING GUIDE DEVICE USED IN A CONTINUOUS CONVEYING TYPE BAG-FILLING PACKAGING MACHINE

(75) Inventors: Iwao Ikemoto, Iwakuni (JP); Shoichi Koga, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 0 days.

(21) Appl. No.: 10/081,172

(22) Filed: Feb. 22, 2002

(65) Prior Publication Data

US 2002/0116905 A1 Aug. 29, 2002

(30) Foreign Application Priority Data

Feb. 23, 2001 (JP) ..... 2001-49297

(51) Int. Cl.[7] ..... B65B 1/04
(52) U.S. Cl. ..... 141/10; 141/313
(58) Field of Search ..... 141/10, 114, 313, 141/182, 268, 267, 270, 271, 279, 283, 284, 134, 135, 137, 166

(56) References Cited

U.S. PATENT DOCUMENTS 1,667,930 A * 5/1928 Edmunds ..... 141/135
2,649,673 A 8/1953 Bartelt
3,152,622 A * 10/1964 Rothermel ..... 141/83

FOREIGN PATENT DOCUMENTS

| | | |
|---|---|---|
| JP | 49-90692 | 8/1974 |
| JP | 57-56969 | 12/1982 |
| JP | 08-310649 | 11/1996 |

* cited by examiner

*Primary Examiner*—Steven O. Douglas
(74) *Attorney, Agent, or Firm*—Koda & Androlia

(57) ABSTRACT

A guide device for loading a solid matter into a bag including: an upper hopper which performs a reciprocating swinging motion along the conveying direction of the bag and about a supporting shaft located in the center of the upper portion of the upper hoppers, and a lower hopper which is positioned beneath the upper hopper and performs a reciprocating horizontal motion along the conveying direction of the bags and also moved toward and away from the upper hopper. The upper hopper's swing motion and the lower hopper's horizontal motion along the conveying direction of the bag are made in synchronization with the movement of the bag, and the lower hopper is lowered so that its lower opening is inserted into the mouth of the bag.

6 Claims, 12 Drawing Sheets

SOLID MATTER LOADING METHOD AND A SOLID MATTER LOADING GUIDE DEVICE USED IN A CONTINUOUS CONVEYING TYPE BAG-FILLING PACKAGING MACHINE

BACKGROUND OF THE INVENTION

1. Field of the Invention

The present invention relates to a method and device for loading solid matter into bags which are continuously and rectilinearly conveyed in the horizontal direction with the bags in a vertical attitude and with the mouths of bags facing upward.

2. Prior Art

Generally, in solid matter loading guide devices used in bag-filling packaging machines, a fixed-quantity measuring device, etc. is disposed above the bag-filling packaging machine. A predetermined quantity of solid matter discharged from an opening in the lower end of a fixed chute which is installed in the fixed-quantity measuring device is caused to drop into the bags via a funnel-form guide member (hopper), etc. installed in the bag-filling packaging machine while the solid matter is guided by the inside surface of the hopper.

In order to perform this operation, the opening opened in the upper end of the hopper must be disposed so as to face the opening opened in the lower end of the fixed chute. In addition, the opening in the lower end of the hopper must face the mouth of the corresponding bag, and loading must be performed in this state. Furthermore, in order to accomplish the loading of solid matter in a secure and stable manner, loading is in some cases performed in a state in which the opening in the lower end of the hopper is inserted into the mouth of the corresponding bag.

In the case of a continuous conveying type bag-filling packaging machine in which respective packaging steps are performed while the bags are continuously conveyed, the opening in the upper end of the hopper must face the fixed chute of the fixed-quantity measuring device while the opening in the lower end of the hopper faces the mouth of the corresponding bag that is being continuously conveyed, and the hopper must move in synchronization with the conveying movement of the bags. Naturally, after loading, the hopper must be moved in the opposite direction and returned to its original position. Furthermore, in cases where the opening in the lower end of the hopper is inserted into the mouth of the corresponding bag during loading, the hopper must be raised during the return movement so that the hopper does not interfere with the bags being conveyed.

Conventionally, there are two types of such hoppers as described below:

(1) Reciprocating Motion Type Hoppers

These are hoppers having a large opening in the upper end, and they are installed so as to reciprocate and to be freely raised and lowered. During the advancing motion of the hopper, the hopper is lowered and moved in synchronization with the bags in the conveying direction of the bags in a state in which the opening in the lower end of the hopper is inserted into the mouth of the corresponding bag (motion in the conveying direction of the bags is taken as an advancing motion). Near the final end position of the advancing motion, the hopper is raised; and then the hopper is moved in the opposite direction without any interference between the opening in the lower end of the hopper and the bags that are being conveyed (this motion in the opposite direction is taken as the return motion), so that the hopper returns to the initial end position of the advancing motion.

However, the opening in the upper end of the hopper must be formed with a considerable length in the direction of the reciprocating motion (a length equal to or greater than the distance of the reciprocating motion). Accordingly, the size of the hopper tends to be large, and the size of the mechanisms used for the reciprocating motion and the raising and lowering of the hopper is also large. As a result, the cost of the apparatus increases. Such a large size also hinders an increase in the speed of the bag-filling packaging machine. Furthermore, as the size increases, there is also an increase in vibration and noise, thus deteriorating the working environment.

(2) Reciprocating Swinging Motion Type Hoppers

These are hoppers that are installed so that the hopper is free to perform a reciprocating swinging motion about a point in the vicinity of the center of the upper end of the hopper and so that the hopper is freely raised and lowered. During the advancing motion, the hopper is lowered, the opening in the lower end of the hopper is moved over a circular-arc-form track in synchronization with the conveying of the bags, and at an intermediate position on this circular-arc-form track, the opening in the lower end of the hopper is inserted into the mouth of the corresponding bag. After arriving at the final end position of the advancing motion, the hopper is raised; and it performs a return motion without any interference between the opening in the lower end of the hopper and the bags that are being conveyed, so that the hopper returns to the initial end position of the advancing motion.

However, since the opening in the lower end of the hopper is inserted into the mouth of the bag while the hopper is in inclination, erroneous insertion in which the opening in the lower end of the hopper catches on the upper edge of the bag tends to occur. Furthermore, the opening in the lower end of the hopper is inserted into the mouth of the corresponding bag for only a part of the entire distance of the advancing motion (in the vicinity of an intermediate position in this advancing motion), so that the ratio of the insertion time (during which loading takes place) to the advancing motion time is small; as a result, loading mistakes tend to occur. Alternatively, in order to increase time for insertion, it is necessary either to lower the speed or to increase the size of the hopper and increase the distance of the reciprocating swinging motion. In either case, an increase in the speed of the bag-filling packaging machine is hindered, and the size of the bag-filling packaging machine tends to be large.

SUMMARY OF THE INVENTION

The present is to solve the problems encountered in the conventional hoppers (solid matter loading guide devices) used in continuous conveying type bag-filling packaging machines.

It is, therefore, an object of the present invention to provide a solid matter loading method and a loading guide device that increase the speed of loading of a solid matter without any need for an increase in size of hoppers and hopper driving mechanism, eliminate solid matter loading errors, and eliminate erroneous insertion of the lower end of a hopper into the mouth of a bag.

The above object is accomplished by a unique solid matter loading method of the present invention for a continuous conveying type bag-filling packaging machine, and in the preset invention:

upon loading a solid matter into bags which are continuously and rectilinearly conveyed in a horizontal direction with the bags in a vertical attitude in the continuous conveying type bag-filling packaging machine, the solid matter is loaded into a bag by:

an upper hopper which performs a reciprocating swinging motion along a conveying direction of the bags and about a point located near a center of an upper portion of the upper hopper, and a lower hopper which is positioned beneath the upper hopper and performs a reciprocating motion along the conveying direction of the bags; wherein when the upper hopper swings in the conveying direction of the bags and the lower hopper is moved in the conveying direction of the bags, the upper hopper swings and the lower hopper is moved in synchronization with a conveyance of the bag, and the solid matter drops and is loaded into the bag by being guided by the upper hopper and lower hopper.

In this method, it is preferable that the lower hopper be movable upward and downward. Also, when the lower hopper is moved in synchronization with the conveyance of the bag in the conveying direction of the bags, the lower hopper is moved downward to a position where an opening at a lower end of the lower hopper is inserted into the mouth of the bag.

In addition, it is also preferable that an opening member be inserted into the mouth of the bag at the time of loading of the solid matter, thus opening the mouth of the bag and keeping the mouth opened.

The above object is further accomplished by a unique structure for a solid matter loading guide device in a continuous conveying type bag-filling packaging machine, the solid matter loading guide device loading a solid matter into bags that are continuously and rectilinearly conveyed in a horizontal direction with the bags in a vertical attitude; and in the present invention the solid matter loading guide device includes:

an upper hopper which performs a reciprocating swinging motion along a conveying direction of the bags and about a point located near a center of an upper portion of the upper hopper, and a lower hopper which is positioned beneath the upper hopper and performs a reciprocating motion along the conveying direction of the bags; wherein the lower hopper performs a reciprocating motion in synchronization with a reciprocating swinging motion of the upper hopper, with an opening in an upper end of the lower hopper being caused to face an opening in a lower end of the upper hopper, and when the lower hopper is moved in the conveying direction of the bags, the lower hopper is moved in synchronization with the conveyance of the bags with the opening in the lower end of the lower hopper being caused to face the mouth of a bag.

In this structure, it is preferable that a plurality of sets of the upper hopper and lower hopper are disposed along the conveying direction of the bags, and respective sets of the upper hopper and lower hopper are disposed at intervals which are equal to a conveying pitch of the bags.

Also, the lower hopper is preferably movable upward and downward, so that when the lower hopper is moved in the conveying direction of the bags, the lower hopper is moved downward to a position where an opening at the lower end of the lower hopper is inserted into the mouth of the bag. At all other times, the lower hopper is raised to a position where the lower opening of the lower hopper is out of the mouth of the bag.

In addition, it is preferable that the solid matter loading guide device further include an opening member that performs a reciprocating motion along the conveying direction of the bags in synchronization with movements of the upper and lower hoppers and makes a reciprocating motion between a position where it is inserted in the mouth of the bag and a position where it is retracted out of the bag. When the opening member is moved in the conveying direction of the bags, the opening member is moved to the position of insertion, opens the mouth of the bag and maintains the mouth opened. At all other times, the opening member is at its retracted position.

DETAILED DESCRIPTION OF THE INVENTION

First, the solid matter loading method and loading guide device of the present invention will be described in schematic terms with reference to FIGS. 1 through 3.

Figure 1:
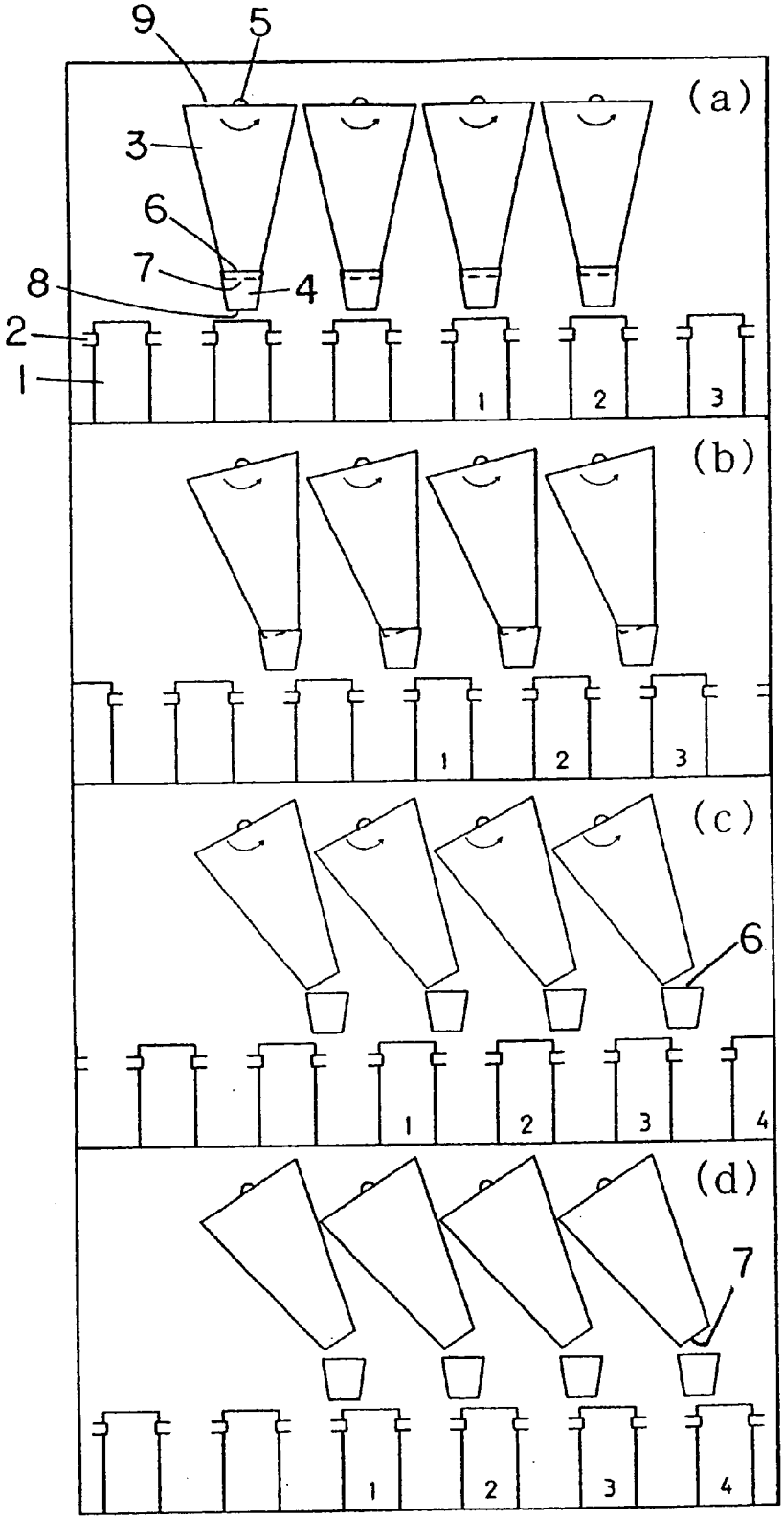
FIG. 1 shows the steps (a) through (d) taken in the solid matter loading method and loading guide device according to the present invention, the steps being in schematic terms.
Figure 2:
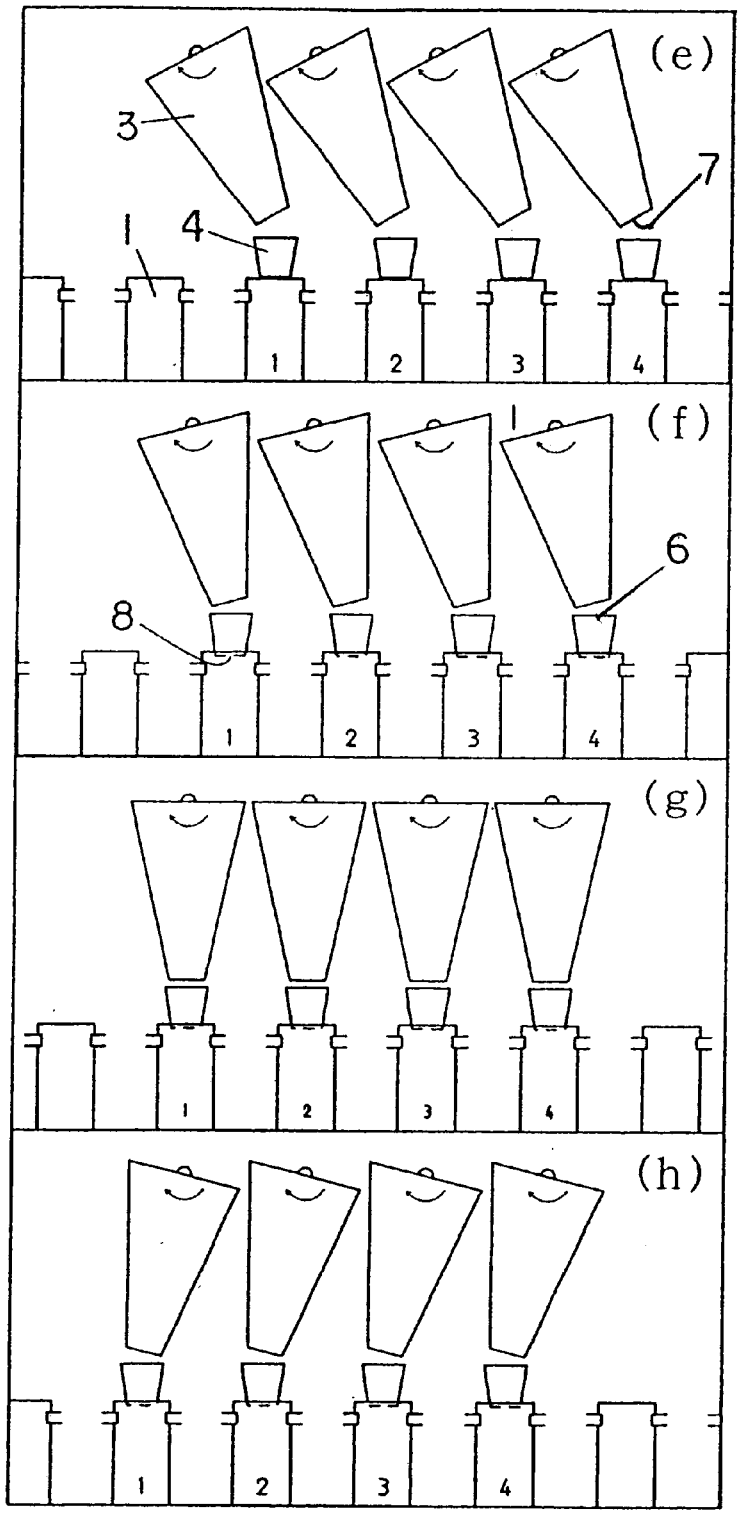
FIG. 2 shows the steps (e) through (h) continuous from the step (d) in FIG. 1.
Figure 3:
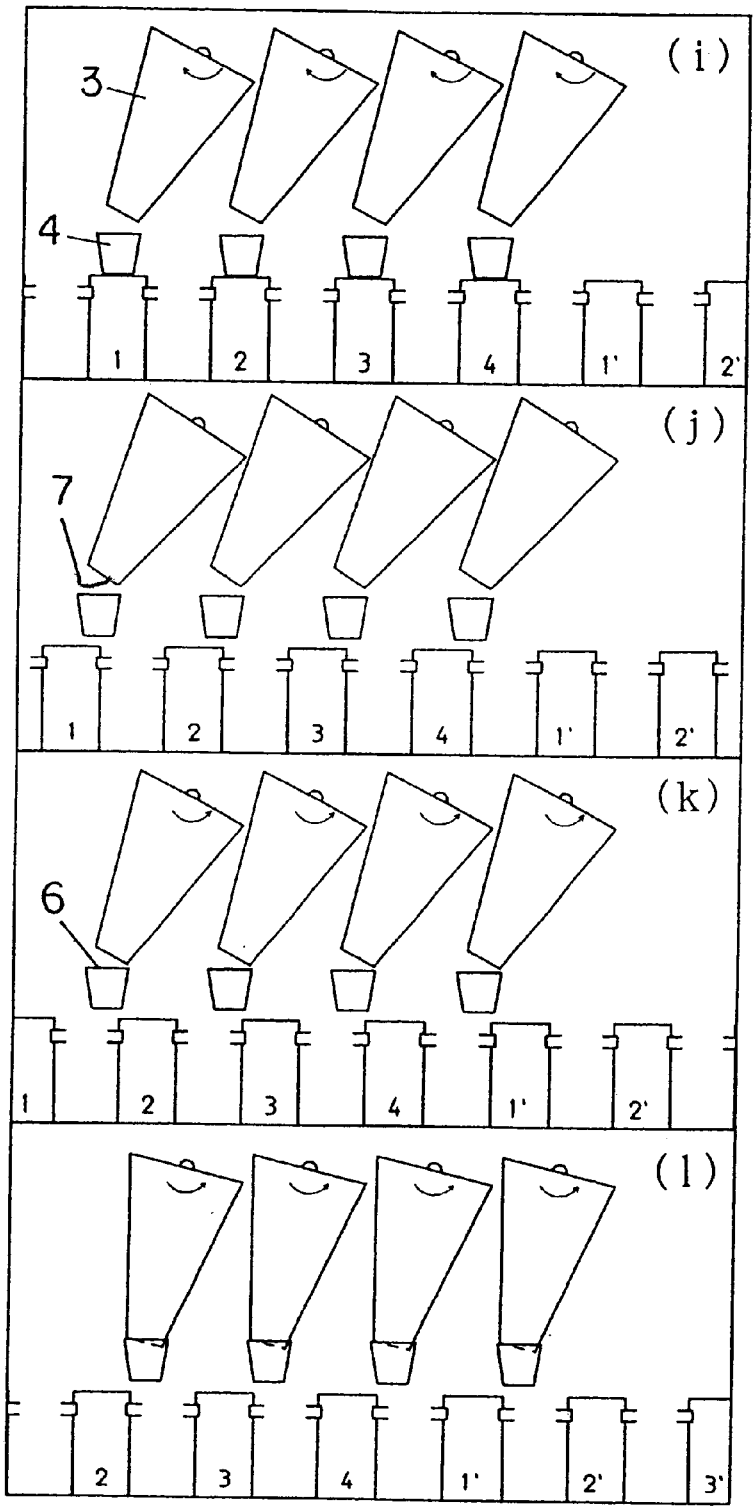
FIG. 3 shows the steps (i) through (l) continuous from the step (h) in FIG. 2.
Figure 4:
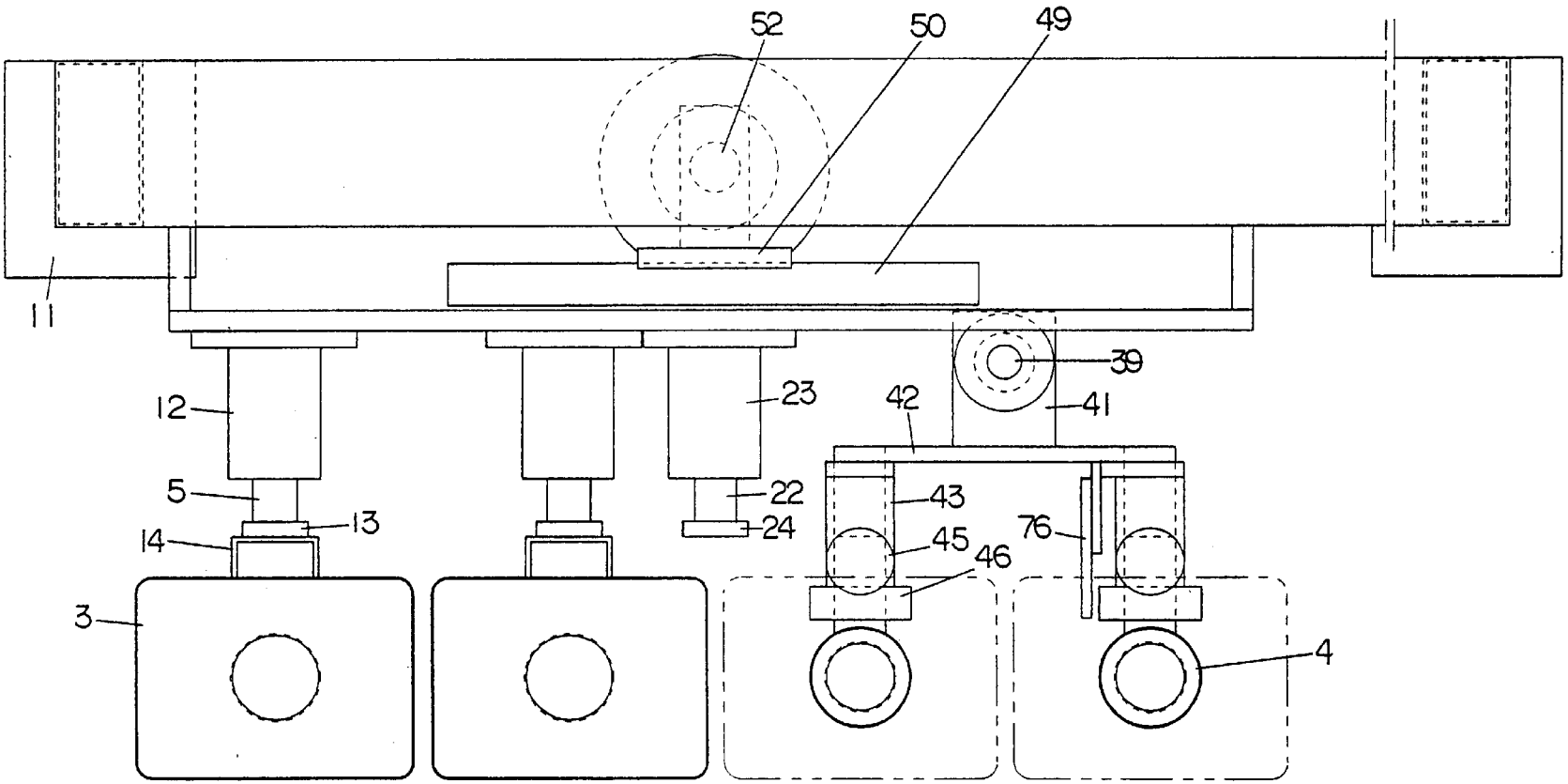
FIG. 4 is a top view of an area where the hoppers are provided in the solid matter loading guide device of the present invention.
Figure 5:
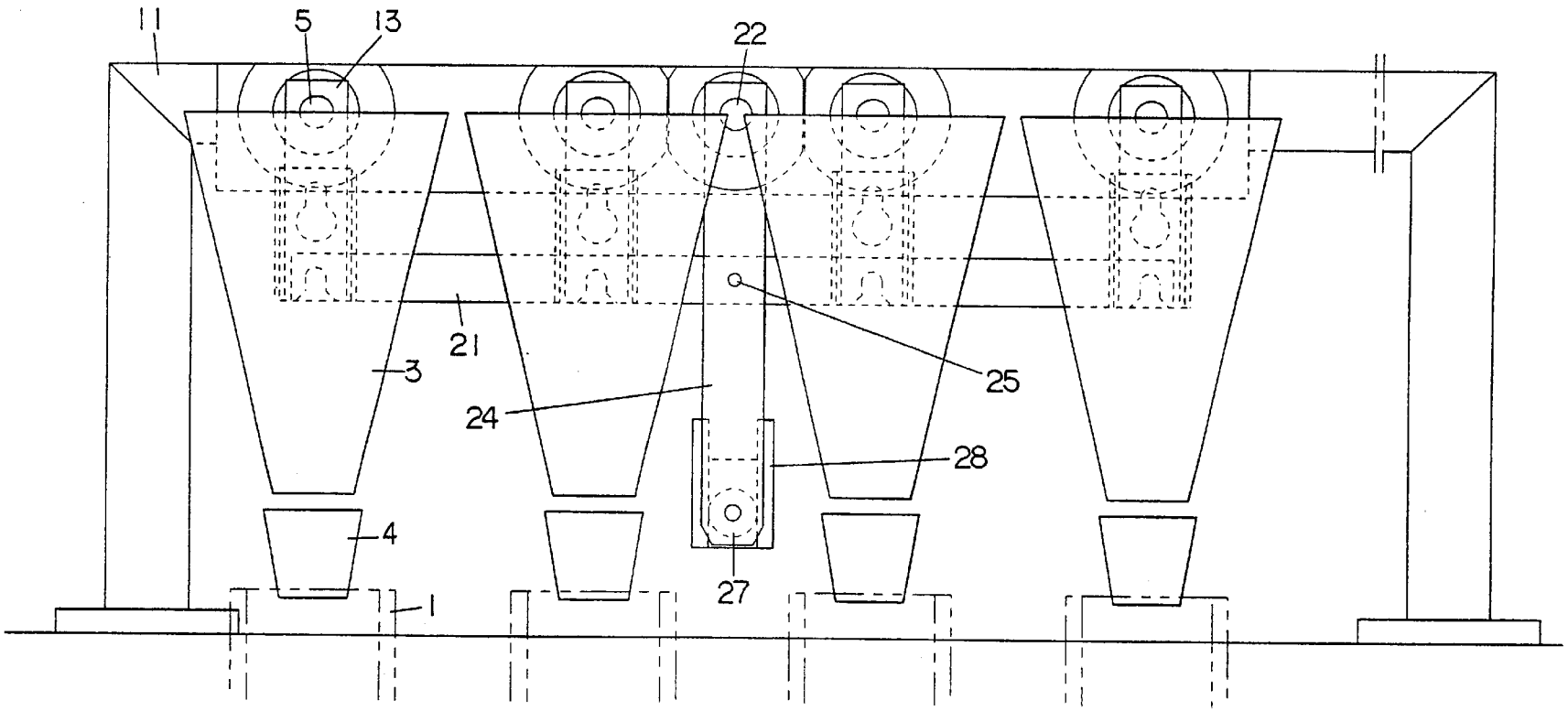
FIG. 5 is a front view thereof.
Figure 6:
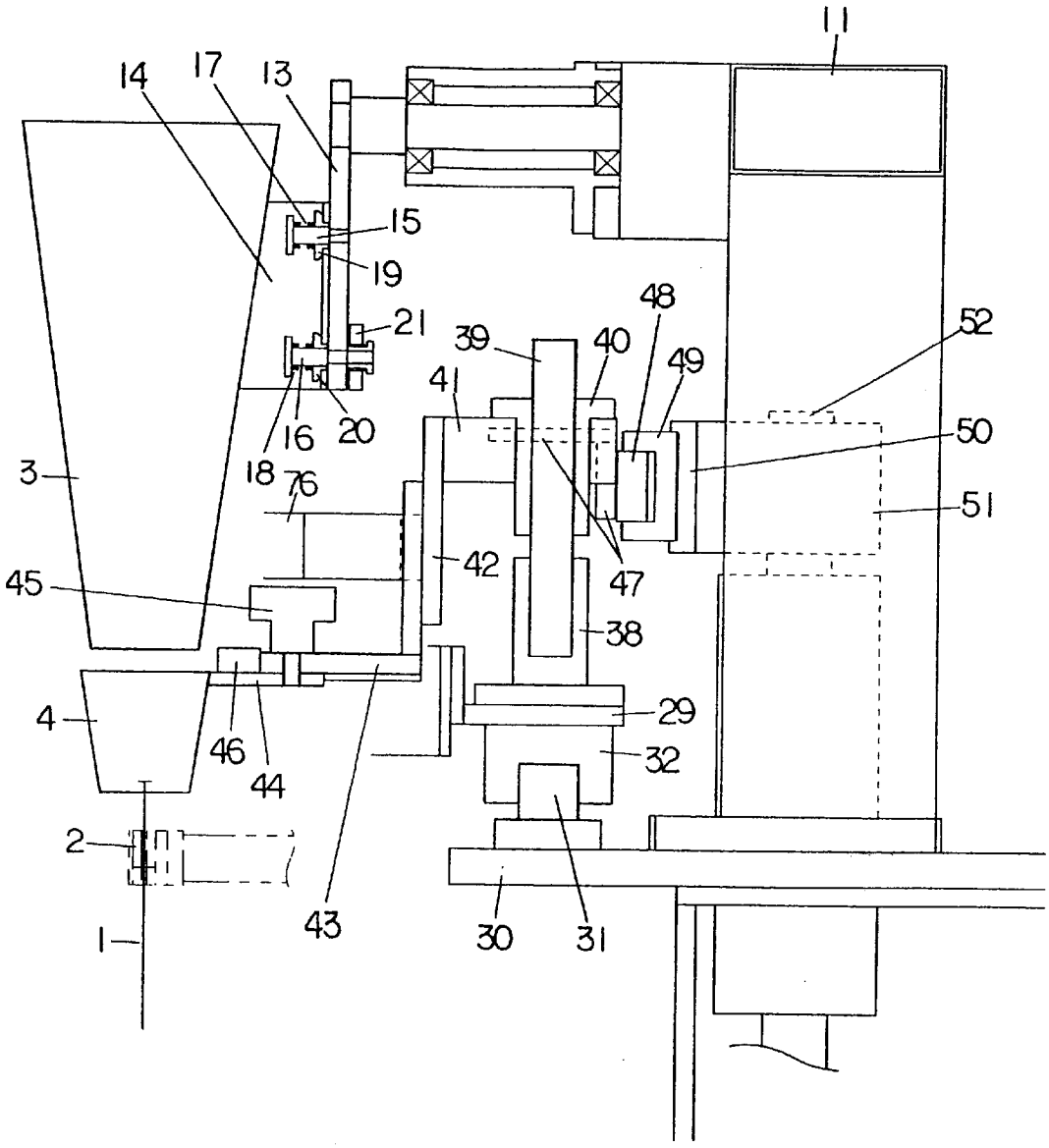
FIG. 6 is a partially sectional side view thereof, showing in particular the attachment structures of the upper hoppers and lower hoppers, and the reciprocating motion means and raising-and-lowering means for the lower hoppers.
Figure 7:
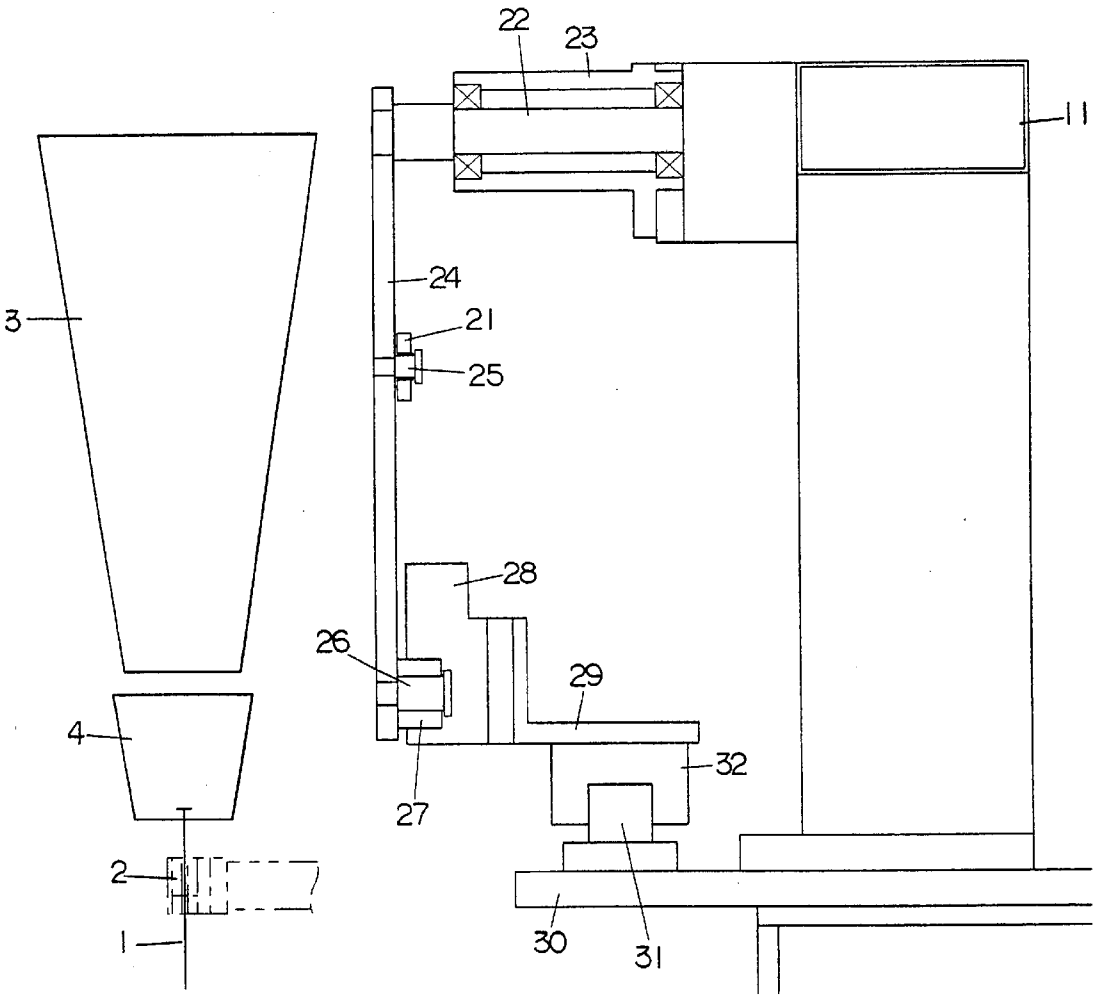
FIG. 7 is a partially sectional side view thereof, showing in particular the swinging means for the upper hoppers.

In the continuous conveying type bag-filling packaging machine used in the present invention, numerous bags 1 are suspended in a vertical attitude with both edges of these bags 1 held by grippers 2, and these bags 1 are continuously conveyed to the left in FIGS. 1 through 3 at equal intervals on a conveying path. Furthermore, this conveying path is arranged as a rectilinear path on the horizontal plane in at least the solid matter loading process (that is performed at portions shown in FIGS. 1 through 3).

In this solid matter loading guide device, a plurality of sets (four sets in the shown embodiment) of upper hoppers 3 and lower hoppers 4 (each set consisting of one upper hopper 3 and one lower hopper 4) are installed along the conveying path of the bags 1 above the conveying path (not shown) for the bags. These sets of hoppers are disposed at intervals which are the same as the conveying pitch of the bags. In the shown embodiment, furthermore, the bags 1 are conveyed in the direction of width of the bags 1. However, the solid matter loading guide device can also be used for cases in which bags are conveyed in the direction perpendicular to the direction of width of the bags.

The respective upper hoppers 3 are caused to simultaneously perform, by a swinging means that will be described below, a reciprocating swinging motion (as shown by curved arrows shown in the upper hoppers 3) in the vertical plane along the conveying direction of the bags 1 and about a swinging supporting shaft 5 that is installed in the center of the upper portion of each upper hopper 3 (swinging supporting shaft 5 being oriented horizontally in a direction perpendicular to the conveying direction of the bags).

The respective lower hoppers 4 are caused to perform a reciprocating horizontal motion, in synchronization with the reciprocating swinging motion of the upper hoppers 3, along the conveying direction of the bags by a reciprocating motion means that will be described below. Openings 6 opened in the upper ends of the lower hoppers 4 are constantly always caused to face the openings 7 that are opened in the lower ends of the upper hoppers 3. The reciprocating swinging time of the upper hoppers 3 and the reciprocating motion time of the lower hoppers 4 are set at a value that is obtained by multiplying the time required for the bags 1 to advance a distance equal to one pitch by the number of sets of upper hoppers 3 and lower hoppers 4.

Furthermore, when the swing of the upper hoppers 3 and the movement of the lower hoppers 4 are oriented in the conveying direction of the bags (below, this will be referred to as the "advancing motion", and motion in the opposite direction will be referred to as the "return motion"), the lower hoppers 4 are set so as to moved in synchronization with the conveying of the bags 1, with the openings 8 that are in the lower ends of the lower hoppers 4 caused to face the mouths of the bags.

Furthermore, the lower hoppers 4 are raised and lowered (thus they are movable upward and downward) by a raising-and-lowering mechanism that will be described below. As a result of the action of this raising-and-lowering mechanism, the lower hoppers 4 are lowered (or are moved away from the upper hoppers 3) during the advancing motion so that the openings 8 opened in the lower ends of the lower hoppers 4 are inserted into the mouths of the bags 1, and then they are raised (or are moved toward the upper hoppers 3) during the return motion so that the openings 8 are extracted from the mouths of the bags 1.

Steps (a) through (l) in FIGS. 1 through 3 show one cycle of the movements of the upper hoppers 3 and lower hoppers 4 (advancing and return motion). The respective steps are described below. In FIGS. 1 through 3, the numbers shown on the surfaces of the bags 1 are provided so as to indicate the positions of bags that are filled with solid matter at one time.

Steps (a) through (c): The upper hoppers 3 and lower hoppers 4 are at intermediate points in the return motion in which the upper hoppers 3 swing in the counter clockwise direction and the lower hoppers 4 move from left to right in FIG. 1. The lower hoppers 4 are in their raised positions.

Step (d): The hoppers are at the initial position of advancing motion, and the return motions of the hoppers are completed.

Step (e): The upper hoppers 3 and lower hoppers 4 begin the advancing motion in which the upper hoppers 3 swing in the clockwise direction and the lower hoppers move from right to left in FIG. 2; at the same time, the lower hoppers 4 begin to be lowered (or be moved away from the upper hoppers 3).

Steps (f) through (h): The lower hoppers 4 reach their lowered positions and are advanced with the openings 8 formed in the lower ends of the lower hoppers 4 inserted in the mouths of the bags. During this period, solid matter that has been measured by a fixed-quantity measuring device (not shown) and dropped through a fixed chute (not shown) is simultaneously loaded into four bags 1 via four sets of upper and lower hoppers 3 and 4.

Step (i): The lower hoppers 4 begin to be raised (or to be moved toward the upper hoppers 3) in the vicinity of the final position of the advancing motion.

Step (j): The lower hoppers reach the final end position of the advancing motion, and the advancing motion of the hoppers is completed. The lower hoppers 4 return completely to their raised positions.

Steps (k) through (l): The return motion is again initiated.

In the solid matter loading guide device, the openings 9 (solid matter receiving portions) opened in the upper ends of the upper hoppers 3 are slightly tilted by the swinging motion, but the upper hoppers 3 are not moved in the horizontal direction. Accordingly, even if the openings 9 have a relatively small size compared to those of conventional reciprocating motion type hoppers, solid matter can be assuredly received from the opening in the lower end of the fixed chute of the fixed-quantity measuring device. Thud, the size of the device can be reduced, and the loading speed can increase.

On the other hand, since the openings 8 in the lower ends of the lower hoppers 4 are moved straight and inserted into the mouths of the bags, erroneous insertion can be prevented (such errors are not possible to avoid in the case of conventional reciprocating swinging motion type hoppers). Furthermore, since the openings 8 in the lower ends of the lower hoppers 4 can be kept inside the mouths of the bags during the advancing motion, a longer time can be taken for the loading of the solid matter than it is possible in the case of conventional reciprocating swinging motion type hoppers, so that loading errors can be prevented.

Furthermore, in the shown embodiment, the lower hoppers 4 are raised and lowered (or are moved toward and away from the upper hoppers 3) by a raising-and-lowering mechanism, and the openings 8 in the lower ends of the lower hoppers 4 are brought into the mouths of the bags 1 during the advancing motion of the bags. Accordingly, the loading of solid matter is performed in a secure and stable manner. However, it is also possible to keep the openings 8 in the lower ends of the lower hoppers 4 outside the mouths of the bags. In this case, the raising-and-lowering mechanism can be omitted, and the lower hoppers 4 perform only a reciprocating motion. Thus, in the case in which the openings 8 in the lower ends of the lower hoppers 4 are not inserted into the mouths of the bags, the solid matter loading guide device can be simplified in structure.

Furthermore, in the above solid matter loading guide device, it is preferable that the gap between the openings 7 in the lower ends of the upper hoppers 3 and the openings 6 in the upper ends of the lower hoppers 4 be set as small as possible when the solid matter is loaded. Accordingly, in the above embodiment, the openings 7 in the lower ends of the upper hoppers 3 are brought into the openings 6 in the upper ends of the lower hoppers 4 when the lower hoppers 4 are raised. Pursuing this even further, it is also possible to set the relationship of both hoppers 3 and 4 so that the lower openings 7 of the upper hoppers 3 are inserted into the upper openings 6 of the lower hoppers 4 at all times (i.e., even when the lower hoppers 4 are lowered).

The solid matter loading guide device shown in FIGS. 1 through 3 will be described in a more concrete manner with reference to FIGS. 4 through 12.

As shown mainly in FIGS. 4 through 7, the swinging supporting shafts 5 are shaft-supported in bearing holders 12 which are disposed on a gate-form frame 11 so that the swinging supporting shafts 5 are rotatable. A supporting lever 13 is fastened to the tip of each swinging supporting shaft 5, and an attachment bracket 14 on the corresponding upper hopper 3 is attached to this supporting lever 13 via supporting pins 15 and 16.

The reference numerals 17 and 18 (see FIG. 6) are compression springs, and 19 and 20 are washers; and these elements are used to attach the attachment bracket 14 to the supporting lever 13 in an elastically compressed state.

One of the supporting pins 16 of each of the upper hoppers 3 also has a role of a connecting pin, and a common connecting plate 21 that extends in the horizontal direction (see FIG. 5) is pivotally connected to this supporting pin 16 so that the connecting plate 21.

At an intermediate position (being at the same height) of the swinging supporting shafts 5 of the respective upper hoppers 3, a separate swinging supporting shaft 22 is shaft-supported in a bearing holder 23 so as to be rotatable, and a swinging lever 24 is fastened to the tip of this swinging supporting shaft 22. The swinging lever 24 is oriented parallel to the supporting levers 13, and a supporting pin 25 (see FIG. 7) connects the connecting plate 21 and swinging lever 24 at the same height as the supporting pins 16 so that the connecting plate 21 and swinging lever 24 are pivotable.

Furthermore, a cam roller 27 is rotatably attached to the lower end of the swinging lever 24 via a supporting pin 26. The cam roller 27 is fitted in a vertical cam groove formed in an upper hopper swing cam 28 (see FIGS. 5 and 7). The upper hopper swing cam 28 is fastened to the side surface of a slide plate 29, and this slide plate 29 is fastened to the top surface of a slide member 32 that slides along a slide rail 31 on a base 30.

Figure 12:
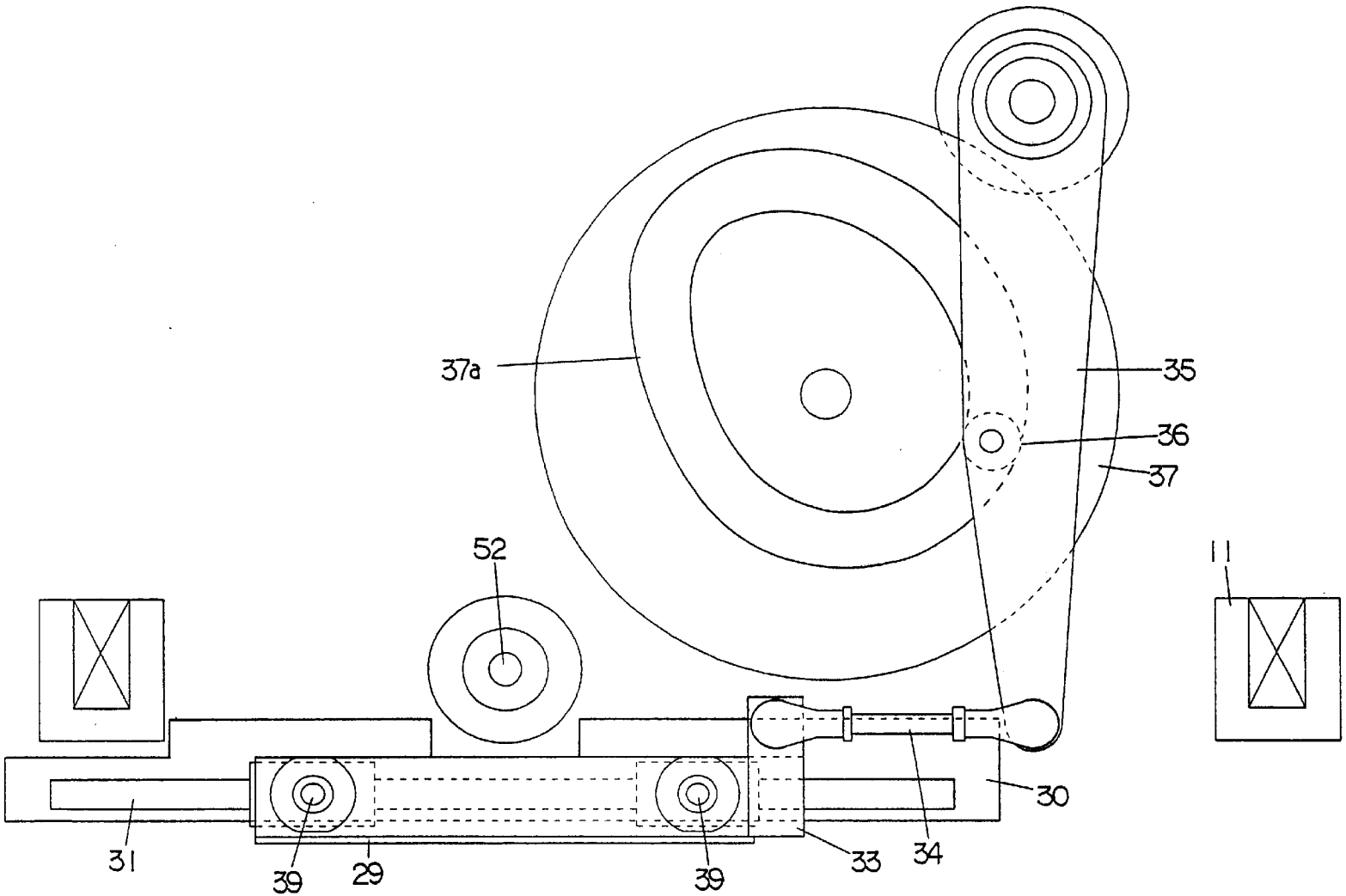
FIG. 12 is a top view of the driving mechanism for the reciprocating swinging motion of the upper hoppers and the reciprocating motion of the lower hoppers.

As seen from FIG. 12, the slide plate 29 is connected via a connecting portion 33 and connecting rod 34 to a cam lever 35 which is shaft-supported at its base end, and a cam roller 36 that is attached to the undersurface of this cam lever 35 is fitted in the cam groove 37*a* (which has a substantially elliptical shape as seen in a top view) of a groove cam 37 which is rotates at a constant speed by a driving means (not shown).

The elements referred to, among others, by the reference numerals 21 (the common connecting plate) through 34 (the groove cam) form the swinging means for the upper hoppers 3 described above. More specifically, when the groove cam 37 is rotated, the slide plate 29 and upper hopper swing cam 28 are caused to perform a reciprocating motion in the horizontal direction via the slide member 32, etc.; as a result, the swinging lever 24 makes a reciprocating swinging motion, so that each upper hopper 3 simultaneously performs a reciprocating swinging motion through the same angle.

Figure 8:
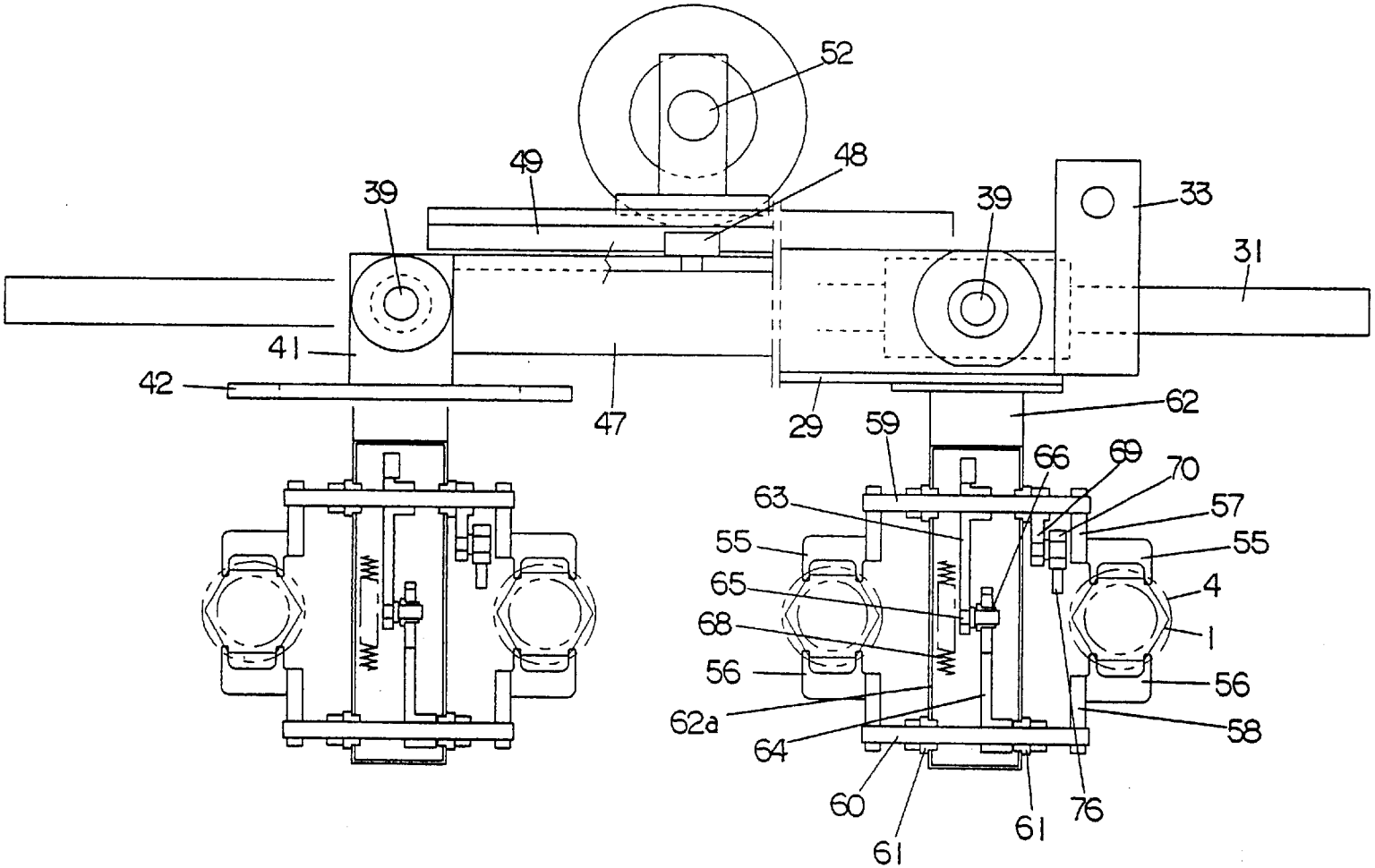
FIG. 8 is a partially sectional top view of the mouth opening device used in the present invention.
Figure 9:
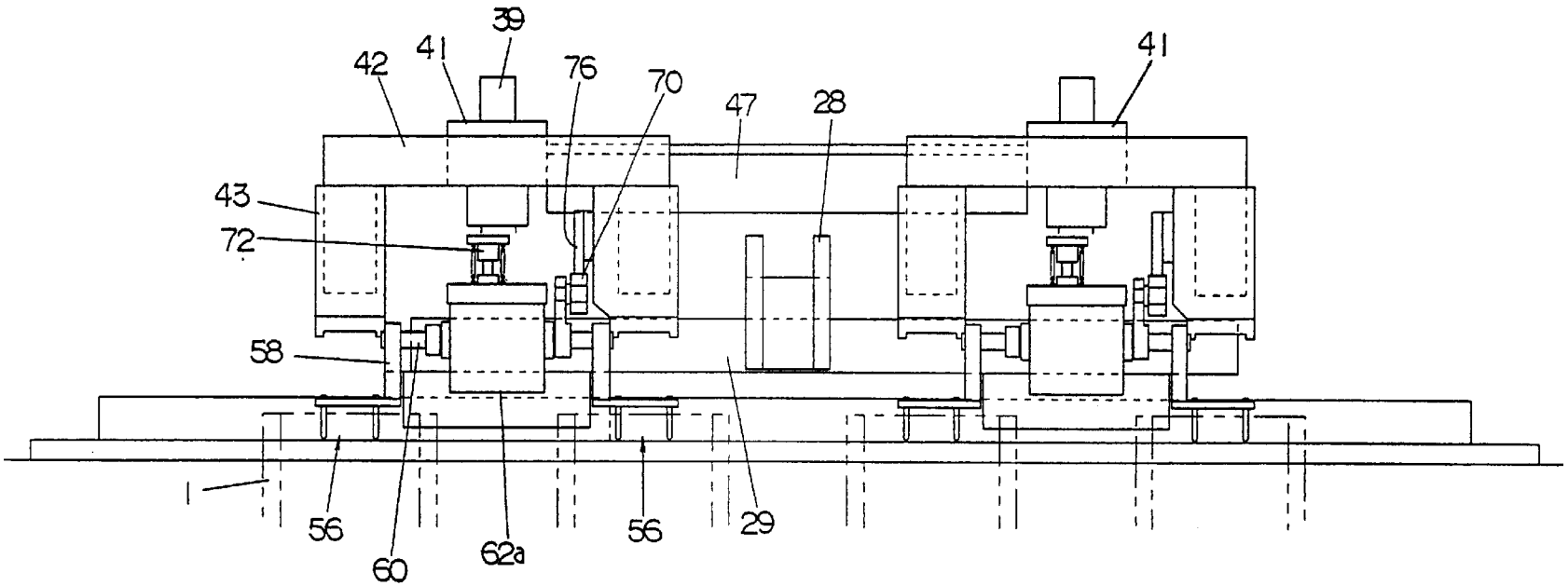
FIG. 9 is a front view of the mouth opening device.

Two raising-and-lowering guide shaft attachment stands 38 are disposed on the upper surface of the slide plate 29, and raising-and-lowering guide shafts 39 are fastened to these raising-and-lowering guide shaft attachment stands 38 (see FIG. 8). Furthermore, a raising-and-lowering frame 41 is attached to each raising-and-lowering guide shaft 39 via a slide bearing 40 so that the raising-and-lowering frame 41 can be raised and lowered. An attachment frame 42 that extends to the left and right (in FIG. 8) is fastened to the tip of each raising-and-lowering frame 41, and attachment plates 43 are fastened to the left and right tips of this attachment frame 42 (see FIG. 4). One lower hopper 4 is attached to each of these attachment plates 43. Furthermore, an attachment bracket 44 is fastened to each lower hopper 4 (see FIG. 6), and this attachment bracket 44 is screw-fastened to the corresponding attachment plate 43 by an attachment knob 45.

The reference numeral 46 refers to a positioning plate that is fastened to the upper surface of each attachment bracket 44, and positioning thereof is accomplished by causing this positioning plate 46 to contact the tip end of the corresponding attachment plate 43.

The two raising-and-lowering frames 41 are connected by a raising-and-lowering plate 47 that has a cross-sectional key shape, and a cam roller 48 is rotatably attached to a central position on the vertical portion of the raising-and-lowering plate 47 (see FIG. 8). The cam roller 48 is fitted in the C-shaped horizontal cam groove of a lower hopper raising-and-lowering cam 49. The vertical positions of the raising-and-lowering frames 41 (and the lower hoppers 4), etc. are regulated by this lower hopper raising-and-lowering cam 49.

The elements referred to, among others, by the reference numerals 29 (the slide plate) through 41 (the raising-and-lowering frames) form the reciprocating motion means for the lower hoppers 4. More specifically, when the groove cam 37 is rotated, the slide plate 29 and raising-and-lowering frames 41, etc. are caused to perform a reciprocating motion in the horizontal direction via the slide member 32, etc. (i.e., the cam roller 48 moves along the horizontal cam groove of the lower hopper raising-and-lowering cam 49); as a result, the respective lower hoppers 4 perform a reciprocating motion simultaneously and in synchronization with the reciprocating swinging motion of the upper hoppers 3.

The lower hopper raising-and-lowering cam 49 is attached via an attachment holder 50 to a raising-and-lowering shaft 52 that is supported in a bearing holder 51 on the base 30. This raising-and-lowering shaft 52 is raised and lowered by a driving means (not shown) at the timing shown in FIGS. 1 through 3.

The raising-and-lowering frames 41 and the group of elements including the raising-and-lowering plate 47 through the raising-and-lowering shaft 52 form the raising-and-lowering mechanism of the lower hoppers 4 described above. More specifically, when the raising-and-lowering shaft 52 is raised and lowered, the lower hopper raising-and-lowering cam 49 is raised and lowered, the raising-and-lowering frames 41 are raised and lowered, and the lower hoppers 4 are, therefore, simultaneously raised and lowered at the timing.

The mouth opening device that constitutes a part of the solid matter loading device will be described with reference mainly to FIGS. 8 through 11.

This mouth opening device makes insertion of the lower hoppers 4 into the mouths of the bags more securely by way of inserting a pair of opening members 55 and 56 into the mouths of the bags, and thus opening the mouths of the bags and maintaining this open state. Even in cases where the lower hoppers 4 are not inserted into the mouths of the bags, the reliability of loading can be increased by way of inserting such opening members into the mouths of the bags during the loading of the solid matter so that the mouths of the bags are opened.

The opening members 55 and 56 are bifurcated fork-shaped members, and they are positioned on both sides of each lower hopper 4. The base portions of respective attachment members 57 and 58 of two pairs of opening members 55 and 56 are fastened to both ends of common supporting shafts 59 and 60, and these supporting shafts 59 and 60 are respectively rotatably supported on the box element 62*a* of a supporting frame 62 via bearings 61. Each supporting frame 62 is fastened to the side surface of the slide plate 29; as a result, the opening members 55 and 56 perform a reciprocating motion together with the lower hoppers 4.

Inside each box element 62*a*, connecting levers 63 and 64 are fastened to points near the centers of the supporting shafts 59 and 60, and the tip end (bush 66) of a pin 65 fastened to the tip end portion of the connecting lever 63 is engaged with a slot 67 formed in the tip end portion of the connecting lever 64, and both connecting levers 63 and 64 are driven by a tension spring 68 in the direction that causes these levers to pivot downward. Furthermore, on the side of each box element 62*a*, a cam lever 69 is fastened to the supporting shaft 59, and a cam roller 70 is attached to the tip of this cam lever 69. The tension spring 68 acts to press this cam roller 70 against the cam surface of an opening member opening-and-closing cam 76 (described later).

Furthermore, a position adjustment knob 72 is attached to the upper surface of each box element 62*a*. The position adjustment knob 72 has a shaft that is engaged by screwing with a supporting portion 71 in which a female screw is formed, and a stopper 73 is attached to the tip end of this shaft part. This stopper 73 contacts the rear end of the connecting lever 63, and thus regulates the limit of the pivoting of this lever 63, i.e., the opening of the opening members 55 and 56 that are inserted into the mouths of the bags. The reference numeral 74 refers to a compression spring used to prevent loosening.

Furthermore, an opening member opening-and-closing cam 76 is attached to the attachment plate 43 of each lower stopper 4 via an attachment element 75 at a position that corresponds to the cam roller 70. This opening member opening-and-closing clam 76 has a cam surface 77 consisting of upper and lower vertical sections and an intermediate inclined section. The cam 76 is raised and lowered together with the corresponding lower hopper 4.

Figure 10:
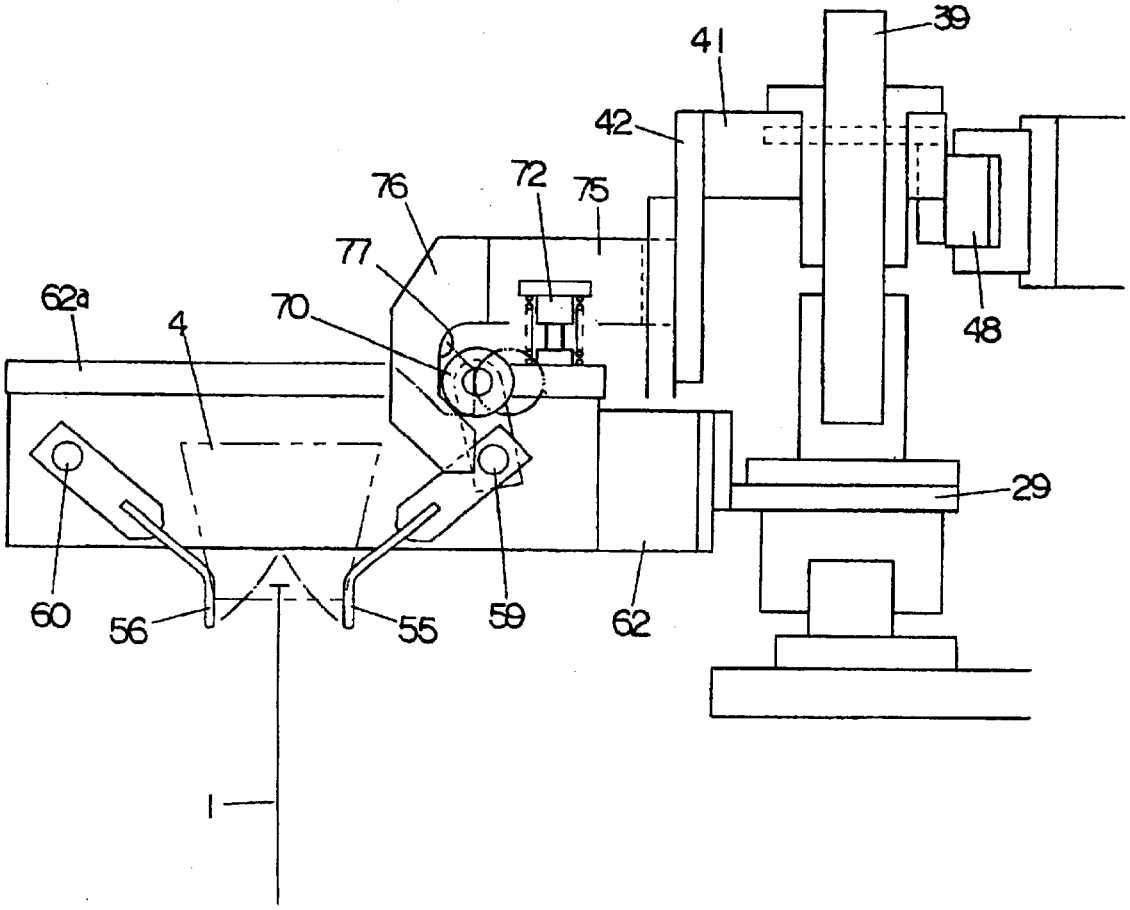
FIG. 10 is a partially sectional side view of the mouth opening device, showing in particular the elements associated with the raising and lowering of the lower hoppers.
Figure 11:
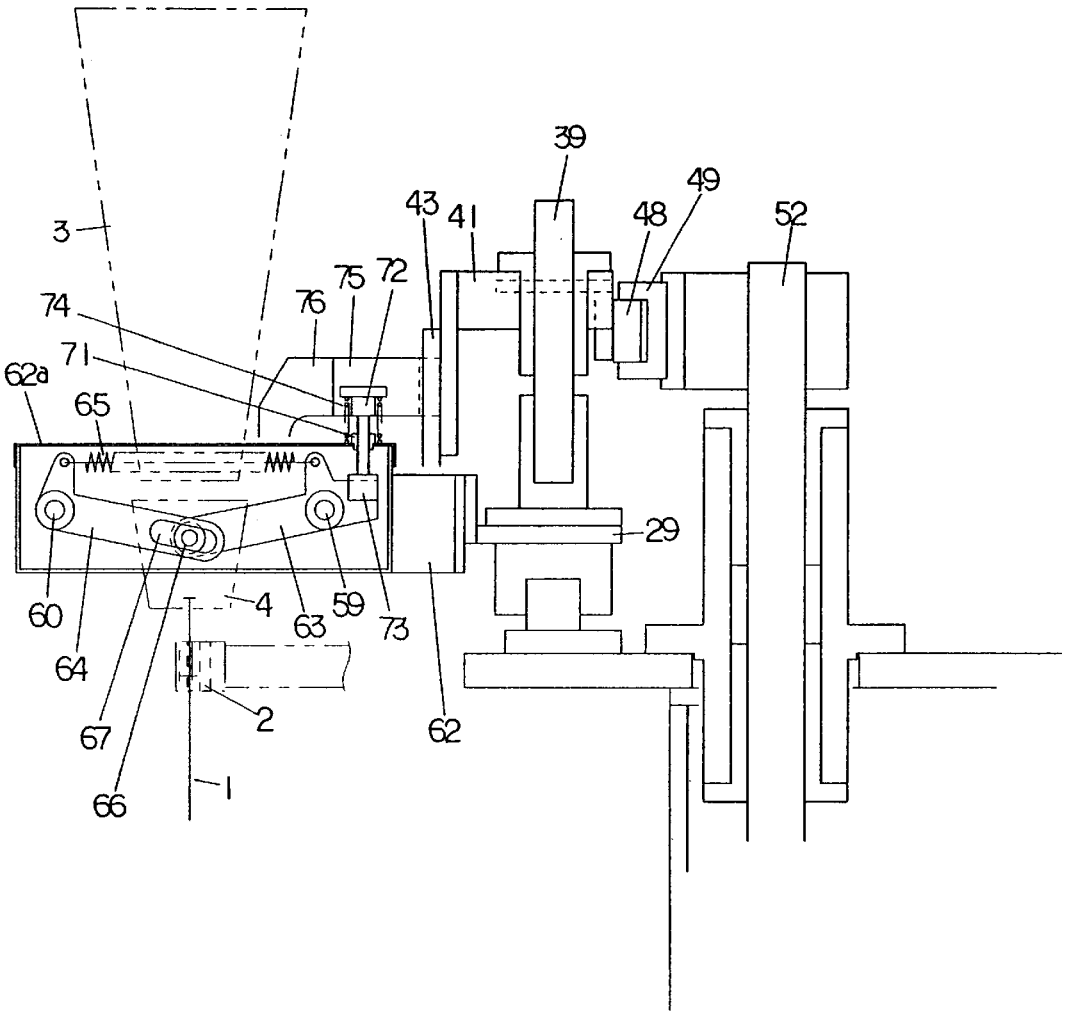
FIG. 11 is a partially sectional side view of the mouth opening device, showing in particular the mechanism that causes the opening members to pivot.

When the opening member opening-and-closing cam 76 reaches the raised position, as shown by the imaginary line in FIG. 10, the cam roller 70 is at the lower vertical section of the cam surface 77, and the opening members 55 and 56 pivot upward about the supporting shafts 59 and 60, thus reaching positions (a retracted position) above the upper edge of the mouth of the corresponding bag 1. When the opening member opening-and-closing cam 76 reaches the lowered position, as shown by the solid lines in FIG. 10, the cam roller 70 is at the inclined section or the upper vertical section of the cam surface 77, and the opening members 55 and 56 pivot downward about the supporting shafts 59 and 60, thus reaching positions below the upper edge of the mouth of the corresponding bag 1, so that the opening members 55 and 56 enter the mouth of the bag 1 (inserted position), open the mouth of the bag 1, and keep the mouth opened.

Thus, the opening members 55 and 56 are positioned in the vicinity of the opening 8 in the lower end of each lower hopper 4, the opening members 55 and 56 perform a reciprocating motion together with the lower hoppers 4, and also perform a reciprocating pivoting motion between a waiting position and an inserted position as the lower hoppers 4 are raised and lowered.

To describe this reciprocating pivoting motion with reference to FIGS. 1 through 3, the opening members 55 and 56 are in the retracted position in steps (a) through (d) of FIG. 1; then, in step (e) in FIG. 2, the opening members 55 and 56 begin to pivot downward toward the inserted position together with the lowering of the lower hoppers 4 and are inserted into the mouths of the bags prior to the insertion of the lower hoppers 4 into the mouths of the bags 1. In steps (f) through (h), the mouths of the bags are opened and maintained in this state with the opening members 55 and 56 in the inserted position. Then, in step (i) of FIG. 3, the opening members 55 and 56 begin to pivot upward toward the retracted position as the lower hoppers 4 are raised; afterward, the opening members 55 and 56 wait in the retracted position.

In the above-described embodiment, the method and device of the present invention are applied to a continuous conveying type bag-filling packaging machine of the gripper type, in which the bags are conveyed while being suspended in a vertical state, with both edges of the bags held by grippers. However, the method and device of the present invention is likewise applicable to continuous conveying type bag-filling packaging machines that have other conveying configurations, such as continuous conveying type bag-filling packaging machines of the retainer type, in which the bags are conveyed while being held in a vertical attitude by retainers.

As seen from the above, the present invention makes it possible to increase the speed of loading of solid matters without increasing the size of the solid matter loading device (in terms of the hoppers and driving mechanism of the device) in a continuous conveying type bag-filling packaging machine. Furthermore, the present invention makes it possible to eliminate solid matter loading errors. Moreover, when the lower ends of the hoppers are inserted into the mouths of the bags, erroneous insertion is prevented in the present invention.

What is claimed is:

1. A solid matter loading method in a continuous conveying type bag-filling packaging machine wherein:

upon loading a solid matter into bags which are held at both ends thereof by grippers and are continuously and rectilinearly conveyed in a horizontal direction with said bags in a vertical attitude in said continuous conveying type bag-filling packaging machine, said solid matter is loaded into a bag by:

an upper hopper which performs a reciprocating swinging motion along a conveying direction of said bags and about a point located near a center of an upper portion of said upper hopper, and a lower hopper which is positioned beneath said upper hopper and performs a reciprocating motion along said conveying direction of said bags; wherein when said upper hopper swings in said conveying direction of said bags and said lower hopper is moved in said conveying direction of said bags, said upper hopper swings and said lower hopper is moved in synchronization with a conveyance of said bag, and said solid matter drops and is loaded into said bag by being guided by said upper hopper and lower hopper, and said lower hopper is movable upward and downward, and when said lower hopper is moved in synchronization with said conveyance of said bag in said conveying direction of said bags, said lower hopper is moved downward to a position where an opening at a lower end of said lower hopper is inserted into a mouth of said bag.

2. The solid matter loading method according to claim 1, wherein an opening member is inserted into said mouth of said bag at a time of loading of said solid mater, so that said mouth of said bag is opened and kept opened.

3. A solid matter loading guide device in a continuous conveying type bag-filling packaging machine, said solid matter loading guide device loading a solid matter into bags that are held at both ends thereof by grippers and are continuously and rectilinearly conveyed in a horizontal direction with said bags in a vertical attitude, wherein said solid matter loading guide device comprises:

an upper hopper which performs a reciprocating swinging motion along a conveying direction of said bags and about a point located near a center of an upper portion of said upper hopper, and a lower hopper which is positioned beneath said upper hopper and performs a reciprocating motion along said conveying direction of said bags; wherein said lower hopper performs a reciprocating motion in synchronization with a reciprocating swinging motion of said upper hopper, with an opening in an upper end of said lower hopper being caused to face an opening in a lower end of said upper hopper, when said lower hopper is moved in said conveying direction of said bags, said lower hopper is moved in synchronization with a conveyance of said bags with said opening in said lower end of said lower hopper being caused to face a month of a bag, and a plurality of sets of said upper hopper and lower hopper are disposed along said conveying direction of said bags, respective sets of said upper hopper and lower hopper are disposed at intervals which are equal to a conveying pitch of said bags, said lower hopper is movable upward and downward, and when said lower hopper is moved in said conveying direction of said bags, said lower hopper is moved downward to a position where an opening at a lower end of said lower hopper is inserted into said mouth of said bag.

4. A solid matter loading guide device in a continuos conveying type bag-filling packaging machine, said solid matter loading guide device loading a solid matter into bags that are held at both ends thereof by grippers and are continuously rectilinearly conveyed in a horizontal direction with said bags in a vertical attitude, wherein said solid matter loading guide device comprises:

an upper hopper which performs a reciprocating swinging motion along a conveying direction of said bags and about a point located near a center of an upper portion of said upper hopper, and a lower hopper which is positioned beneath said upper hopper and performs a reciprocating motion along said conveying direction of said bags; wherein said lower hopper performs a reciprocating motion in synchronization with a reciprocating swinging motion of said upper hopper, with an opening in an upper end of said lower hopper being caused to face an opening in a lower end of said upper hopper, when said lower hopper is moved in said conveying direction of said bags, said lower hopper is moved in synchronization with a conveyance of said bags with said opening in said lower end of said lower hopper being caused to face a mouth of a bag, and said lower hopper is movable upward and downward, and when said lower hopper is moved in said conveying direction of said bags, said lower hopper is moved downward to a position where an opening at a lower end of said lower hopper is inserted into said mouth of said bag.

5. The solid matter loading guide device according to claim 3 or 4 further comprising:

an opening member which performs a reciprocating motion along said conveying direction of said bags in synchronization with movements of said upper and lower hoppers and performs a reciprocating motion between a position of insertion into said mouth of said bag and a position of retraction to an outside of said bag, and when said opening member is moved in said conveying direction of said bags, said opening member is moved to said position of insertion, opens said mouth of said bag and maintains said mouth opened.

6. The solid matter loading guide device according to claim 4, further comprising:

an opening member which performs a reciprocating motion along said conveying direction of said bags in synchronization with movements of said upper and lower hoppers and performs a reciprocating motion between a position of insertion into said mouth of said bag and a position of retraction to an outside of said bag, and when said opening member is moved in said conveying direction of said bags, said opening member is moved to said position of insertion, opens said mouth of said bag and maintains said mouth opened.

* * * * *